US005088560A

United States Patent [19]

Fawal

[11] Patent Number: 5,088,560

[45] Date of Patent: Feb. 18, 1992

[54] ZERO FORCE FIRE EXTINGUISHER

[75] Inventor: Omar M. Fawal, Antioch, Calif.

[73] Assignee: Systron Donner Corporation, Concord, Calif.

[21] Appl. No.: 607,661

[22] Filed: Nov. 1, 1990

[51] Int. Cl.[5] ..... A62C 35/08; A62C 3/08

[52] U.S. Cl. ..... 169/28; 169/58; 169/62; 169/70

[58] Field of Search ..... 169/28, 58, 62, 70, 169/37; 239/523, 524, 265.27; 244/129.2, 135 R

[56] References Cited

U.S. PATENT DOCUMENTS

| | | | |
|---|---|---|---|
| H141 | 10/1986 | Finnerty et al. | 169/28 |
| 576,026 | 1/1897 | Bunker et al. | 169/28 |
| 3,482,637 | 12/1969 | Mitchell et al. | 169/28 X |
| 4,702,322 | 10/1987 | Richardson | 169/62 X |
| 4,834,187 | 5/1989 | Bragg | 169/28 X |
| 4,854,389 | 8/1989 | Warren et al. | 169/58 X |
| 4,938,293 | 7/1990 | Warren et al. | 169/58 X |

FOREIGN PATENT DOCUMENTS

| | | | |
|---|---|---|---|
| 289299 | 11/1988 | European Pat. Off. | 169/28 |
| 262697 | 12/1926 | United Kingdom | 169/62 |

*Primary Examiner*—Johnny D. Cherry
*Assistant Examiner*—James M. Kannofsky
*Attorney, Agent, or Firm*—Flehr, Hohbach, Test, Albritton & Herbert

[57] ABSTRACT

A linear fire extinguisher of the type containing superpressurized Halon in a cylindrical container which is cut by an explosive linear shaped charge is contained in an overall housing which, in addition to preventing fragments from escaping, diverts the outflow of extinguishant to provide an equal and opposite reaction force to the momentum force of the outflow. In addition, the diversion occurs through apertures in the housing to opposed paths in directions substantially perpendicular to the reaction forces to again, nullify any forces due to this perpendicular outflow. The invention is also applicable to other container configurations where a high impulse force might occur.

8 Claims, 4 Drawing Sheets

ZERO FORCE FIRE EXTINGUISHER

The present invention is directed to a fire extinguisher and more specifically to a fire extinguisher especially useful for the dry bay of fuel tanks in airplane wings and fuselages which when explosively cut supplies a zero net reaction force on the airframe of the aircraft.

BACKGROUND OF THE INVENTION

The use of linear fire extinguishers in the form of a high strength, elongated tube containing a pressurized fire extinguishant such as Halon 1301 has been suggested both in U.S. Pat. Nos. 4,854,389 (the '389 patent) and 4,938,293 (the '293 patent), both assigned to the present assignee. Here, a shaped charge is placed parallel to an axis of the tube and when detonated cuts the tube to allow for distribution of the fire extinguishant in less than 10 milliseconds. The installation is typically in the dry bay of a military aircraft to rapidly extinguish fires due to, for example, a punctured fuel tank. Moreover, in the '293 patent, in order to provide a net reaction force substantially zero on the tube and thus reduce stresses on the air frame, it has been proposed that the pressurized tube or container be cut on opposed sides to theoretically provide a net reaction force of substantially zero. Also in that same patent a helical geometry is disclosed which reduces the reactive force.

OBJECT AND SUMMARY OF THE INVENTION

It is a general object of the present invention to provide an improved fire extinguisher.

In accordance with the above object there is provided a linear fire extinguisher for use attached to the airframe of an aircraft, and other similar applications, where a linear distribution of a fire extinguishing agent is accomplished along a long linear distance by use of a high strength tubular container having an axis along which it is elongated, containing a highly pressurized fire extinguishant which is released by explosively cutting along a line, substantially parallel to said axis and extending the length of the container. Such release of the extinguishant and resultant outflow causes a reaction force, R1, from said airframe. The extinguisher comprises means for providing an opposite and substantially equal force, R2, to the force R1 relative to said airframe including deflector means mounted to said airframe adjacent the cutting line for redirecting the outflow of extinguishant into a pair of opposed paths lying in a plane substantially perpendicular to the forces R1 and R2. The outflow on the opposite paths produces forces which substantially cancel each other.

DESCRIPTION OF PREFERRED EMBODIMENTS

Figure 1:
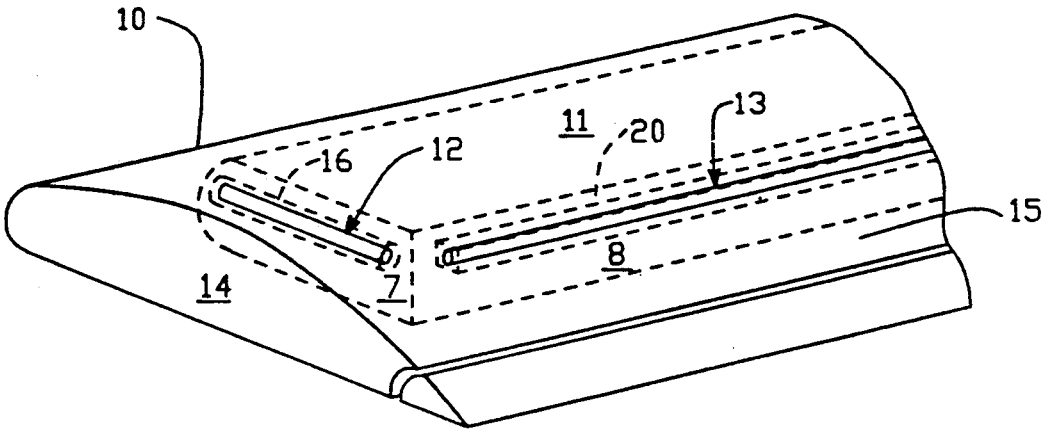
FIG. 1 is a perspective view showing the linear fire extinguisher of the present invention installed in the dry bay of an airplane wing.

FIG. 1 illustrates the wing section 10 with a fuel cell 11 shown in dashed outline. The walls 7 and 8 of the fuel cell necessarily are attached to or form an effective part of the wing airframe section 10. Attached to walls 7 and 8 are linear fire extinguishers 12 and 13 which, in accordance with the present invention, are contained in housings 16 and 20 respectively which are mounted on the walls 7 and 8. The unoccupied portions of the wing shown at 14 and 15 are known as dry bays.

The invention, of course, has other applications as, for example, an engine compartment of an aircraft or land vehicle. Or, in fact, in other non-aircraft applications where it is desired to immediately extinguish fires but where at the same time, it is desired to minimize impulse load on the supporting structure.

Figure 2:
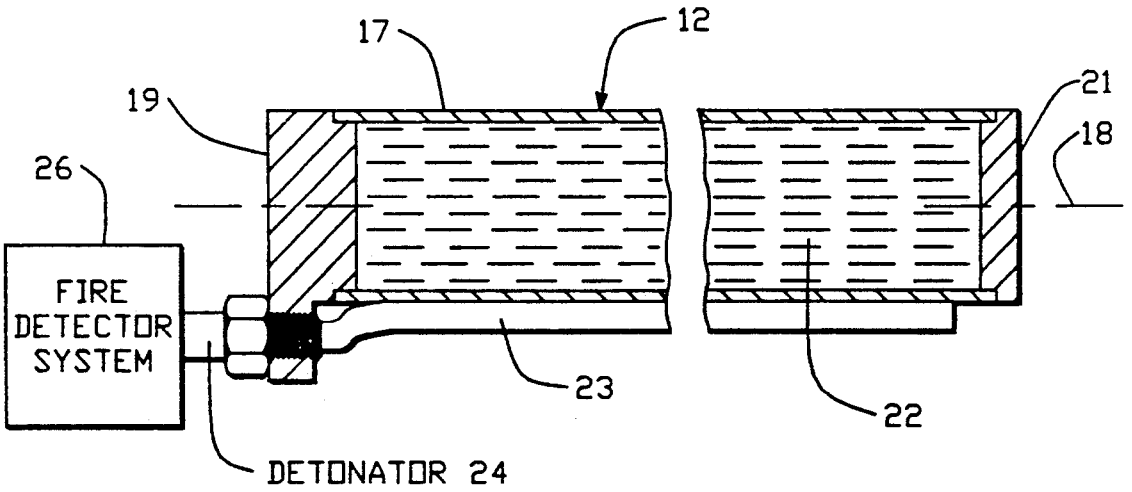
FIG. 2 is a cross-sectional view of a simplified portion of the fire extinguisher showing it connected to a fire detection system.

FIG. 2 illustrates the pressure vessel or container portion of a linear fire extinguisher 12 where the housing 16 has been eliminated for simplicity. As described in the above-mentioned patents, the linear fire extinguisher includes a welded tubular container 17 containing a extinguishing agent (extinguishant) 22 superpressurized with gaseous nitrogen. Container 17 has an axis 18 and is sealed at its ends by plugs 19 and 21 so that pressures of several thousand psi may be applied. Extending along the outside of tube 17 is a flexible linear shaped charge 23 which, when actuated by detonator 24 is capable of cutting through the entire wall thickness of the container 17. The extinguishant under pressure is then rapidly discharged within a few milliseconds into the hazard area. The fire detection system 26 when attached to detonator 24 would normally actuate the system. All of the foregoing is described and claimed in the above '389 patent.

Since the shaped charge which might typically be sold under the trademark "Jetcord" may cut the cylinder wall (along a line substantially parallel to axis 18) and may perform the cutting along the entire length of the container 17 in a time interval measured in microseconds, the impulse or reaction force generated by the outflow to the pressurized extinguishant may be quite high; that is thousands of pounds of force. In fact, a wing structure of an aircraft is relatively fragile and there may be some danger to such wing structure. The necessity of reducing the force, of course, was discussed in the above '293 patent. It is believed that when superpressurized Halon 1301 is used as the fire extinguishant the ensuing discharge transient event may be highly turbulent and unsteady in nature. Since the Halon agent is under extreme chemical potential differences, it flashes (or changes from liquid to vapor phase) in a few milliseconds in 30–40% of its content. It is reasonable to expect that some of the agent discharges in liquid form and perhaps 30–40% is immediately vapor. Thus, it is believed that the nature of the expelled agent flow is a two-phase unsteady flow with intermediate changes from liquid to vapor. It is also believed that in any instant in time because of local properties of, for example, density, velocity, etc. that the exiting fluid may not have any repeatable or identical properties at any instant in time. In other words, there may be, depending on the environment (including particular structure) and the extinguishant (Halon) used a relatively unrepeatable or unsteady discharge.

Figure 3:
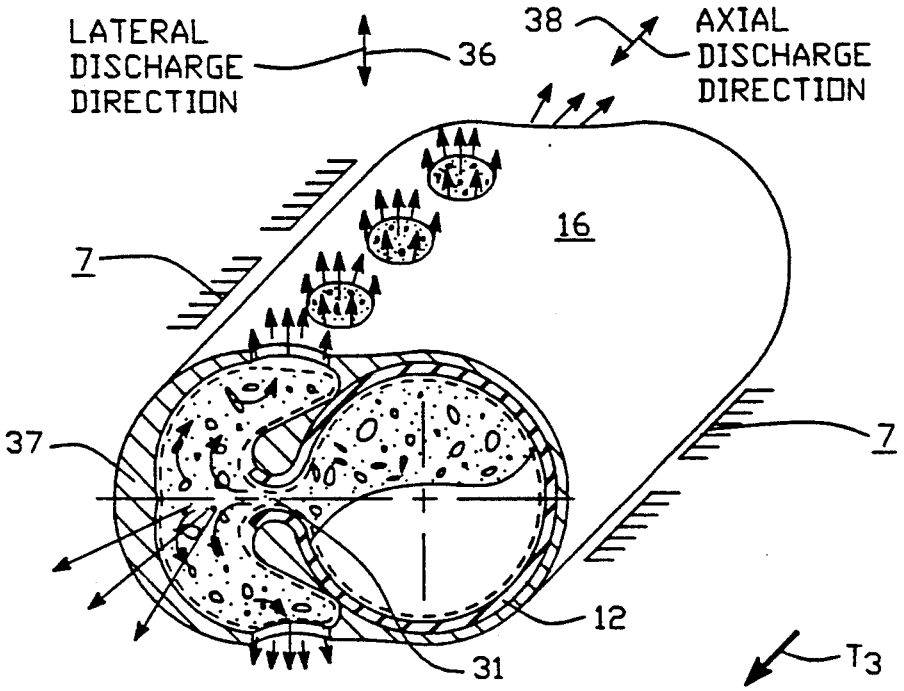
FIG. 3 is a perspective view in cross-section of one embodiment of the fire extinguisher shown in FIG. 1.
Figure 4:
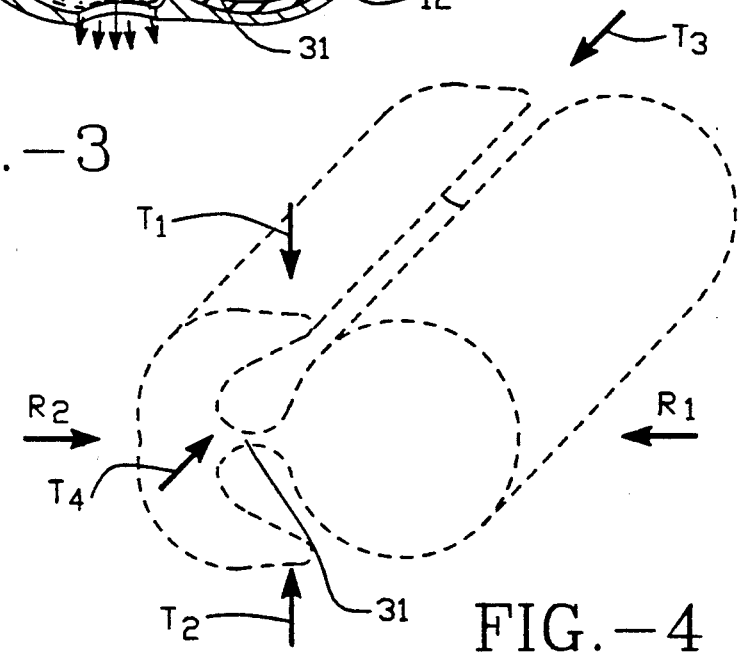
FIG. 4 shows FIG. 3 in phantom illustrating the forces produced by actuation of the fire extinguisher.
Figure 5:
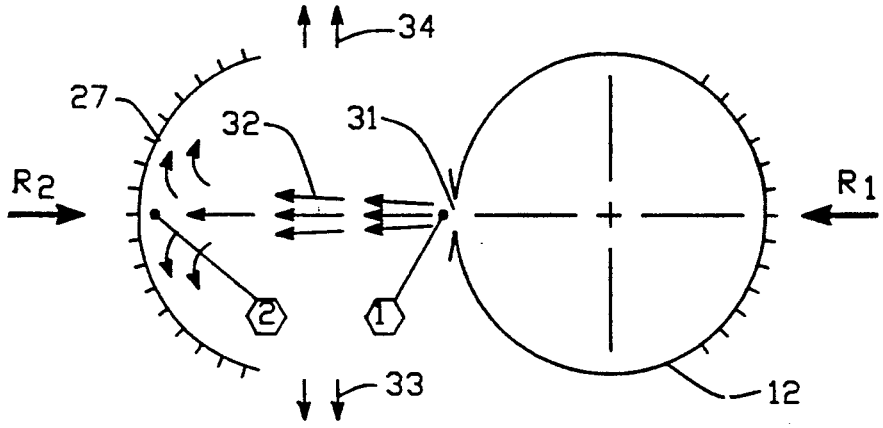
FIG. 5 is a simplified view of FIG. 4.

In accordance with the invention, in order to compensate for the random transient nature of the reaction force R1 caused by the release and outflow of a extinguishant material from the container 17, an equal and opposite force R2 may be provided by use as illustrated in FIG. 3 of a deflector 27. The linear fire extinguisher 12 may be housed in the elongated strengthened container 16 which includes a curved deflector portion 27. The outflow of extinguishant through the linear opening 31 (better shown in FIGS. 4 and 5) produces a reaction force on the airframe structure R1. Referring to FIGS. 3, 4 and 5, this outflow indicated at 32 is deflected by the deflector 27 which, because it is changing the direction of the momentum has an opposed force R2. Deflector 27, as illustrated, substantially changes the direction of the outflow into the opposed paths 33 and 34. Such paths are substantially perpendicular to the plane of the forces R1 and R2. At the same time, these opposed paths produce the forces T1 and T2 (or rather the reaction to these paths) which, because of the geometry of the housing 16 and its apertures 36 substantially cancel each other because of their equal and opposite vector magnitudes. From an axial point of view, designated by the vector 38, (FIG. 3) any axial forces shown in FIG. 4 as T3 and T4 also nullify each other. In practice housing 16 is connected to the airframe structure which is illustrated as the wall 7 of the fuel cell 11. All of the reaction forces of FIG. 4, since they cancel each other on the common housing provide zero force on the airframe.

Housing 16 besides providing deflector 27 also serves the important function of restricting flying fragments.

In general, the reaction force R1 is due to the momentum outflow rate through opening 31 of the extinguishant. When the outflow 32 reaches the deflector structure 27 another velocity/momentum change occurs. Because of this change the reaction force R2 is generated. The magnitude of R2 is significantly affected by both the distance from the outflow area 31 designated point 1, to the effective deflection point 2 and also by the geometrical configuration of deflector 27. For example, the more a change in direction at point 2, the greater the reaction force.

With respect to the distance between points 1 and 2 the magnitude of the reaction force R2 is affected in two ways. First, the magnitude of the momentum arriving at point 2 decreases with increased distance because the two-phase liquid flow 32 will slow down as it expands outwardly. Secondly, the time-phase relationship between the R1 and R2 transients will affect the net reaction force and thus, the effectiveness of the R2 magnitude. Very simply, the time delay between R1 and R2 must be minimized but yet allow for the full dispersal outflow of the extinguishant.

Figure 7C:
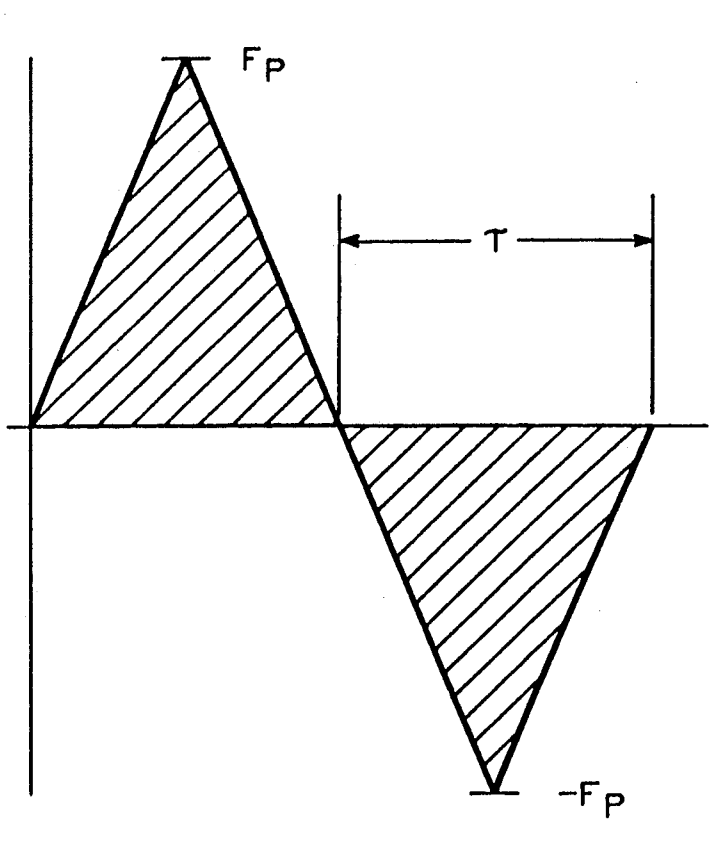
FIGS. 7A, 7B and 7C are diagrams illustrating the concept of the invention.
Figure 7B:
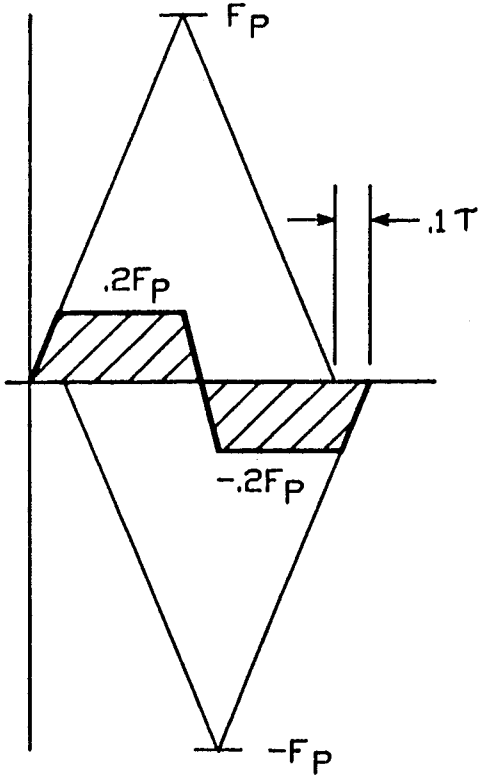
Figure 7A:
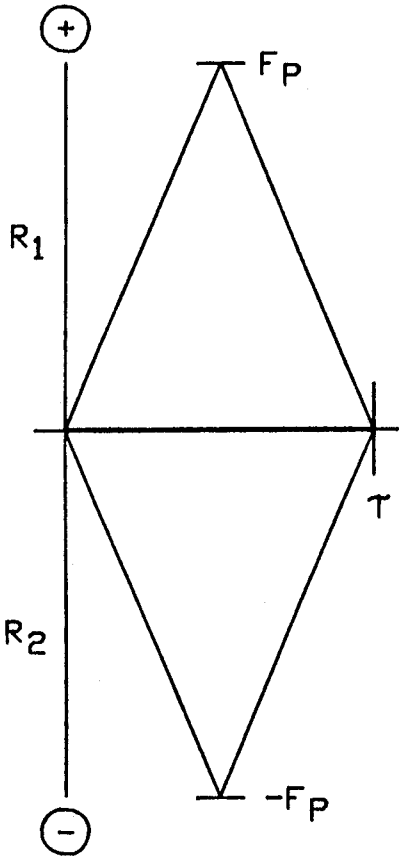

FIG. 7A shows a theoretical zero time delay between R1 and R2 where the forces are illustrated as a triangular waveshapes in full opposition. These achieve the ideal impulse force of zero. To achieve this goal, the distance between points 1 and 2 should be as near to zero as practicable and the degree of momentum change (turning) should be sufficient to produce a force R2 very nearly equal in magnitude to force R1.

The plot of FIG. 7B shows a more realistic situation where R1 and R2 are out of phase by 10% of the time interval of the time duration T. This is the time over which the effective outflow occurs to produce the triangular force illustrated. With this 10% of time offset the net force rather than zero is shown by the cross-hatch portion 41 as being 20% of the peak impulses both in the positive and negative directions. In other words, there is an effective impulse force created by this outflow of the extinguishant which has been cut to 80% of the peak force designated as $F_p$. This 80% reduction in load is still believed to be effective.

Thus, the spacing of the deflector 27 which might produce such a time delay would be, for example, as follows. If, for example, the total discharge time was 1 millisecond and the agent discharge speed 5 inches/millisecond, then the distance between points 1 and 2 should be limited to 0.5 inch. The graph of FIG. 7C shows the situation where the forces are entirely out of synchronization (for example, where the deflector 27 is 5 inches from the discharge opening 31) and thus is entirely ineffectual.

Figure 6A:
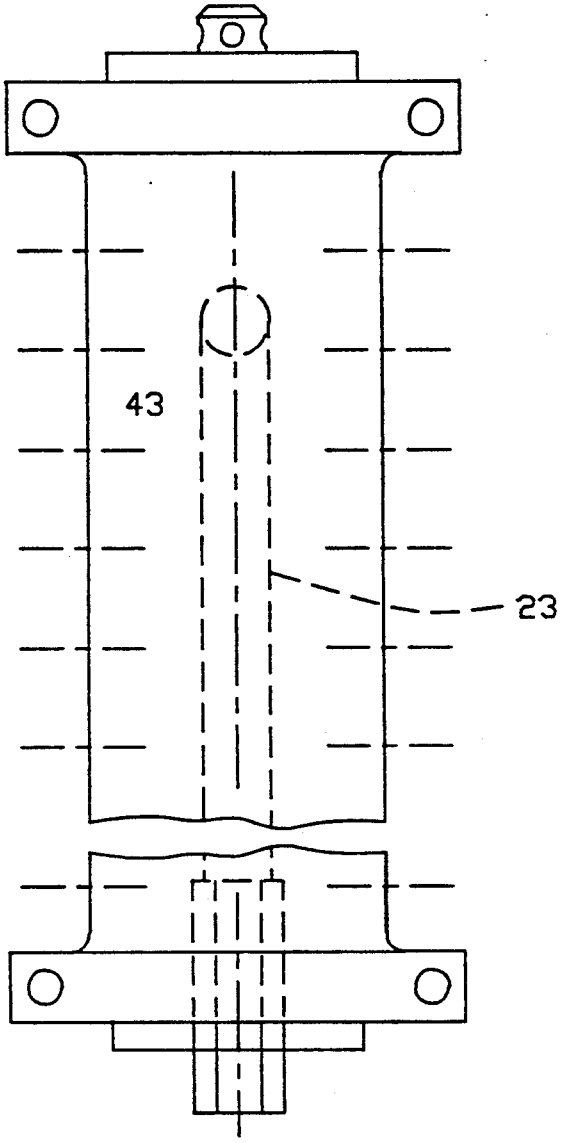
FIG. 6A is a top view of another embodiment of a fire extinguisher embodying the present invention.
Figure 6C:
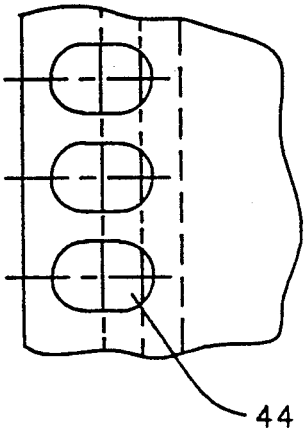
FIG. 6C is a fragmentary side view of FIGS. 6A and 6B.
Figure 6B:
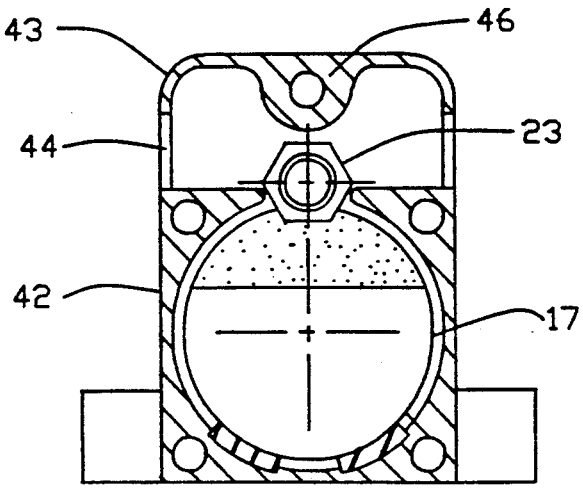
FIG. 6B is a cross-sectional view of FIG. 6A.

FIGS. 6A, 6B and 6C illustrate an alternative embodiment which was actually tested and which resulted in an 85% impulse reduction. Referring to FIG. 6B the housing 42 of this embodiment besides including the linear fire extinguisher in its container 17 along with its detonating cord 23, also has a U-shaped portion 43 with apertures 44 and a center diverter 46. The diverter extends along the entire length of the U-shaped portion 43. Typical dimensions are a length of 10 inches with the container 17 having a diameter of 1.8 inches, the portion 43 having a height of 1.0 inch with the apertures 44 being ½ inch in diameter. Such apertures as best shown in FIG. 6C are arranged along the sides of the U-shaped housing 43. The overall housing 42 effectively prevents any fragments from being released.

In summary, a zero force linear fire extinguisher has been provided where a linear and uniform agent distribution occurs in a protected hazard area. The enclosed design also prevents fragments from the explosively cut container 17 from becoming propulsive and causing damage to parts in the immediate vicinity The container also protects the explosive cord from damage during handling and storage. Finally, any random variations of outflow force are immediately compensated for since that same random variation will be immediately compensated by the same reaction force R2 provided by the associated deflector.

Since the general concept of the invention is to nullify reaction forces, it is equally applicable to other configurations of fire extinguishers where a large opening with a fast discharge, typically a few milliseconds or less, causes a high impulse force.

What is claimed:

1. A linear fire extinguisher, for use attached to the airframe of an aircraft and other similar applications where a linear distribution of a fire extinguishing, agent, is accomplished along a long linear distance, consisting of a high strength tubular container having an axis along which it is elongated, said container comprising means for containing a highly pressurized fire extinguishant, said extinguisher having a means for releasing said extinguishant which comprises means for explosively cutting along a line, substantially parallel to said axis and extending the length of the container, wherein such release of said extinguishant and resultant outflow causes a reaction force, R1, from said airframe; said extinguisher comprising:

means for providing an opposite and substantially equal force, R2, to said force R1 relative to said airframe including deflector means mounted to said airframe adjacent said cutting line for redirecting said outflow of extinguishant into a pair of opposed paths lying in a plane substantially perpendicular to the forces R1 and R2, and for producing forces which substantially cancel each other.

2. A fire extinguisher as in claim 1 where said deflector means is spaced close enough to said cutting line to provide a means for minimizing any time differential between R1 and R2 and yet allow for full dispersal and outflow of said extinguishant.

3. A fire extinguisher as in claim 1 where said deflector means includes diverter means for providing said two opposed paths.

4. A fire extinguisher as in claim 1 where said container and deflector means are parts of a unitary housing fastened to said airframe.

5. A fire extinguisher as in claim 4 where said unitary housing comprises means for impeding fragments of said cut container from hitting said airframe.

6. A fire extinguisher as in claim 4 where said unitary housing includes opposed rows of apertures for providing exit areas for said opposed pair of flow paths.

7. A method of explosively cutting a linear fire extinguisher and nullifying any reaction force, R1, where such extinguisher is attached to the airframe of an aircraft where a linear distribution of a fire extinguishing agent is accomplished along a long linear distance by use of a high strength tubular container having an axis along which it is elongated, containing a highly pressurized fire extinguishant which is released by explosively cutting along a line, substantially parallel to said axis and extending the length of the container, such release of said extinguishant and resultant outflow causing a reaction force, R1, from said airframe; said method comprising the following steps:

explosively cutting said container along said line; and deflecting said outflow into a pair of opposed paths substantially perpendicular to said force, R1, said deflecting providing an opposite force R2 to R1 of substantially the same magnitude and the deflected outflow on said opposed paths producing substantially equal and opposite forces.

8. A fire extinguisher, for use attached to the airframe of an aircraft and other similar applications where a distribution of a fire extinguishing agent is accomplished along a long linear distance, consisting of a high strength container, said container comprising means for containing a highly pressurized fire extinguishant, said extinguisher having a means for releasing said extinguishant in a short period of time such as a few milliseconds, wherein such release of said extinguishant and resultant outflow causes a reaction force, R1, from said airframe; said extinguisher comprising:

means for providing an opposite and substantially equal force, R2, to said force R1 relative to said airframe including deflector means mounted to said airframe adjacent said outflow for redirecting said outflow of extinguishant into a pair of opposed paths lying in a plane substantially perpendicular to the forces R1 and R2, and means for producing forces which substantially cancel each other.

* * * * *